US006656600B2

(12) United States Patent
Strangman et al.

(10) Patent No.: US 6,656,600 B2
(45) Date of Patent: Dec. 2, 2003

(54) CARBON DEPOSIT INHIBITING THERMAL BARRIER COATING FOR COMBUSTORS

(75) Inventors: Thomas E. Strangman, Prescott, AZ (US); Dave Narasimhan, Flemington, NJ (US); Jeffrey P. Armstrong, Tempe, AZ (US); Keith R. Karasek, Elk Grove Village, IL (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 09/932,246

(22) Filed: Aug. 16, 2001

(65) Prior Publication Data

US 2003/0035945 A1 Feb. 20, 2003

(51) Int. Cl.[7] ..... F02B 31/00; F02B 75/08; B32B 9/00

(52) U.S. Cl. ..... 428/472; 123/306; 123/668; 428/332; 428/469; 428/698; 428/701; 428/702

(58) Field of Search ..... 428/469, 472, 428/332, 698, 701, 702; 123/306, 668

(56) References Cited

U.S. PATENT DOCUMENTS

| | | | |
|---|---|---|---|
| 4,055,705 | A | 10/1977 | Stecura et al. |
| 4,248,940 | A | 2/1981 | Goward et al. |
| 4,861,618 | A | 8/1989 | Vine et al. |
| 5,073,433 | A | 12/1991 | Taylor |
| 5,514,482 | A | 5/1996 | Strangman |
| 5,683,761 | A | 11/1997 | Bruce et al. ..... 427/596 |

*Primary Examiner*—Archene Turner
(74) *Attorney, Agent, or Firm*—Robert Desmond, Esq.

(57) ABSTRACT

A carbon deposit inhibiting thermal barrier coating for an internal element or component in a gas turbine engine. Such coating includes a layer of thermal barrier material coated onto the surface of an engine component that will be exposed to the flow of burning engine gases. Such coating further includes a layer of carbon deposit inhibiting material coated on top of the layer of thermal barrier material.

21 Claims, 1 Drawing Sheet

CARBON DEPOSIT INHIBITING THERMAL BARRIER COATING FOR COMBUSTORS

BACKGROUND OF THE INVENTION

This invention relates to thermal barrier coatings for protecting internal components in a gas turbine engine from oxidation and corrosion during engine operation.

When a stream of incompletely burned atomized fuel droplets reaches the wall of the combustor in a gas turbine engine, a localized reducing atmosphere is created. This enables carbon deposits to form on the combustor wall. This condition usually occurs after the spray pattern of one or more fuel nozzles deteriorates, producing larger liquid fuel droplets. If the carbon deposits can bond to the combustor wall, large carbon nodules (several cubic centimeters in volume) can build up. Such localized reducing conditions can also cause carbon to form from fuel droplets prior to their collision with the wall. These small carbon particles can then bond upon impact with the wall, leading to carbon build-up. Periodic breaking off of pieces of these carbon deposits results in significant erosion damage to turbine airfoils, particularly to the first stage turbine blades, which impact with the carbon particles at speeds up to 2000 feet per second. Impact with turbine blades typically pulverizes the carbon nodules into much finer particles. Trailing edges of high-pressure turbine vanes and coatings on turbine shrouds are also damaged by grit blasting by high speed debris from pulverized carbon nodules.

Carbon bonding to the combustor wall is facilitated when the localized gaseous environment produced by the stream of impinging fuel droplets reduces carbide forming surface oxides. For example, for an uncoated superalloy combustor wall, reduction of chromium oxide permits chromium carbide to form, which bonds the carbon nodule to the combustor wall. Similarly, when a yttria stabilized zirconia thermal barrier coating is coated on the combustor wall, reduction of zirconium oxide permits zirconium carbide to form and bond the carbon nodule to the wall.

For the foregoing reasons, it would be desirable to provide some means for inhibiting the bonding of carbon nodules and carbon deposits to combustor walls in gas turbine engines.

More or less representative forms of thermal barrier coatings for use in gas turbine engines are described in U.S. Pat. No. 4,055,705 to Stephan Stecura and Curt Leibert, U.S. Pat. No. 4,248,940 to George Goward, Delton Gray and Richard Krutenat, U.S. Pat. No. 4,861,618 to Raymond Vine, Keith Sheffler and Charles Bevan, U.S. Pat. No. 5,073,433 to Thomas Taylor, and U.S. Pat. No. 5,514,482 to Thomas Strangman. These patents, however, make no mention of the carbon nodule problem and fail to suggest a solution to such problem.

SUMMARY OF THE INVENTION

In accordance with one feature of the invention, there is provided a carbon deposit inhibiting thermal barrier coating for an element (e.g., combustor wall) in a gas turbine engine. This coating comprises a layer of thermal barrier material formed on an exposed surface of a gas turbine engine element. This coating further comprises a layer of carbon deposit inhibiting material formed on top of the layer of thermal barrier material.

In accordance with another feature of the invention, there is provided an article for use in a gas turbine engine. Such article comprises a gas turbine engine element having a surface that will be exposed to burning engine gases and fuel droplets. Such article also includes a layer of thermal barrier material coated onto the engine element surface that will be exposed. This thermal barrier coating layer is typically composed of an insulative oxide layer and thin associated sublayers, such as an oxidation resistant bond coat that facilitates adhesion to the underlying surface. Such article further includes a layer of carbon deposit inhibiting material coated onto the outer surface of the thermal barrier material.

In accordance with a further feature of the invention, there is provided a method of forming a carbon deposit inhibiting thermal barrier coating on a gas turbine engine surface that will be exposed to the flow of burning engine gas and fuel droplets. Such method includes the step of depositing a layer of thermal barrier material onto the engine surface that will be exposed to the gas flow. Such method includes the further step of depositing a layer of carbon deposit inhibiting material onto the layer of thermal barrier material For a better understanding of the present invention, together with other and further advantages and features thereof, reference is made to the following description taken in connection with the accompanying drawing, the scope of the invention being pointed out in the appended claims.

DETAILED DESCRIPTION OF THE INVENTION

Figure 1:
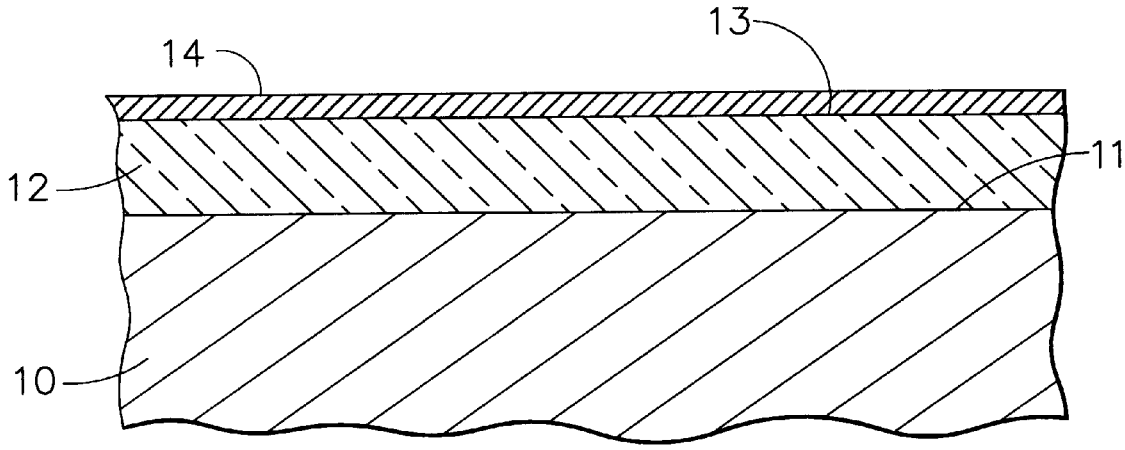
FIG. 1 is an enlarged cross-sectional view of a portion of a combustor wall having a novel coating of the present invention deposited thereon.

The present invention provides a novel carbon deposit inhibiting thermal barrier coating for use on internal gas turbine engine surfaces that will be exposed to the flow of burning engine gas and fuel droplets. A primary candidate for the application of this coating is the internal wall of the engine combustor. FIG. 1 shows a portion of a combustor wall 10. An inner surface 11 of wall 10 would be exposed to the flow of engine fuel combustion gases in the absence of the novel coating of this invention. Wall 10 is typically made of a superalloy metal such as a nickel based alloy or a cobalt based alloy.

The coating of this invention includes a layer 12 of thermal barrier material that is formed on the inner surface 11 that would otherwise be exposed to the high temperature engine gases. Thermal barrier layer 12 may be composed of a ceramic material such as, for example, a predominately yttria stabilized zirconia material. Thermal barrier layer 12 should have a thickness in the range of five to one hundred mils. In addition, thermal barrier layer 12 typically has thin associated sublayers (not shown), such as an oxidation resistant bond coat that facilitates adhesion to the underlying surface 11.

The coating of this invention further includes a layer 14 of carbon deposit inhibiting material formed on top of the layer 12 of thermal barrier material. This carbon deposit inhibiting layer 14 may be coated onto the outer surface 13 of the thermal barrier layer 12. The carbon deposit inhibiting layer 14 may be composed of a non-reactive, non-reducible, refractory oxide material. Primary requirements for this refractory oxide material are high temperature stability to oxidizing combustion gases that may contain up to 20% water vapor and to carbon-rich reducing environments. Such material should also have diffusional stability with respect to the underlying ceramic thermal barrier layer 12. Examples of oxides that meet these criteria are alumina, yttria, and lanthanum oxide. These oxides are not reduced by carbon at temperatures below 2000 degrees Centigrade, a temperature well above the use temperature of combustors. Furthermore, these materials exhibit a high degree of stability on the thermal barrier coating 12 due to their good bonding characteristics and their compatible thermal expansion characteristics. The carbon deposit inhibiting layer 14 should have a thickness in the range of one to five mils and up to fifty mils.

The carbon deposit inhibiting layer 14 may be preferably applied to the thermal barrier layer 12 by plasma spraying immediately following deposition of the thermal barrier layer 12, which may also be applied by plasma spraying. This strategy enables coating costs to be minimized by enabling both layers to be sequentially deposited in a single equipment set-up. Other processes that may be used to apply the protective layers include electron beam physical vapor deposition, chemical vapor deposition, and slurry dipping.

The carbon deposit inhibiting layer 14 of the present invention will inhibit the ability of carbon nodules to adhere strongly to combustor wall surfaces and will prevent carbon deposits from growing to a size sufficient to erode coated superalloys and turbine shroud coatings or to produce significant impact damage to ceramic engine components.

The present invention is not limited to the treatment of combustor walls. The novel coating of the present invention may also be applied to other internal engine components such as, for example, a swirler or fuel nozzle tip. Furthermore, the internal engine element to be coated may be formed of either a superalloy or a ceramic material, such as a silicon carbide composite or a silicon nitride material.

While there have been described what are at present considered to be preferred embodiments of this invention, it will be obvious to those skilled in the art that various changes and modifications may be made therein without departing from the invention and it is, therefore, intended to cover all such changes and modifications as come within the true spirit and scope of the invention.

We claim:

1. A carbon deposit inhibiting thermal barrier coating for an element in a gas turbine engine, such coating consisting essentially of:

a layer of thermal barrier material formed on an exposed surface of a gas turbine engine element exposed to combustion gases;

a 1 to 50 mil thick, continuous layer of carbon deposit inhibiting material applied on top of the layer of thermal barrier material; and wherein the carbon deposit inhibiting material is a refractory oxide selected from a group consisting of yttria and lanthanum oxide.

2. A carbon deposit inhibiting thermal barrier coating in accordance with claim 1 wherein the gas turbine engine element is a combustor wall.

3. A carbon deposit inhibiting thermal barrier coating in accordance with claim 1 wherein the gas turbine engine element is a swirler.

4. A carbon deposit inhibiting thermal barrier coating in accordance with claim 1 wherein the thermal barrier material is a ceramic material.

5. A carbon deposit inhibiting thermal barrier coating in accordance with claim 1 wherein the thermal barrier material is a ceramic material having a bond coat to facilitate oxidation resistance and adhesion to the underlying surface.

6. A carbon deposit inhibiting thermal barrier coating in accordance with claim 1 wherein the thermal barrier material is predominately stabilized zirconia.

7. A carbon deposit inhibiting thermal barrier coating in accordance with claim 1 wherein the thermal barrier material is predominately yttria stabilized zirconia.

8. A carbon deposit inhibiting thermal barrier coating in accordance with claim 1 wherein the thermal barrier layer has a thickness in the range of five to one hundred mils.

9. A carbon deposit inhibiting thermal barrier coating in accordance with claim 1 wherein the carbon deposit inhibiting layer has a thickness in the range of one to five mils.

10. An article for use in a gas turbine engine, such article consisting essentially of:

a gas turbine engine element having a surface that will be exposed to engine gases and fuel droplets;

a layer of thermal barrier material coated onto the engine element surface that will be exposed to combustion gases;

a 1 to 50 mil thick, continuous layer of carbon deposit inhibiting material coated onto the outer surface of the thermal barrier material; and wherein the carbon deposit inhibiting material is a refractory oxide selected from a group consisting of yttria and lanthanum oxide.

11. An article in accordance with claim 10 wherein the gas turbine engine element is formed of a superalloy material.

12. An article in accordance with claim 10 wherein the gas turbine engine element is formed of silicon nitride or a silicon carbide composite material.

13. An article in accordance with claim 10 wherein the gas turbine engine element is a combustor wall.

14. An article in accordance with claim 10 wherein the gas turbine engine element is a swirler or fuel nozzle tip.

15. An article in accordance with claim 10 wherein the thermal barrier material is a ceramic material.

16. An article in accordance with claim 10 wherein the thermal barrier material is a ceramic material having a bond coat to facilitate oxidation resistance and adhesion to the underlying surface.

17. An article in accordance with claim 10 wherein the thermal barrier material is predominately stabilized zirconia.

18. An article in accordance with claim 10 wherein the thermal barrier material is predominately yttria stabilized zirconia.

19. An article in accordance with claim 10 wherein the thermal barrier layer has a thickness in the range of five to one hundred mils.

20. An article in accordance with claim 10 wherein the carbon deposit inhibiting layer has a thickness in the range of one to five mils.

21. An article in accordance with claim 10 wherein:

the gas turbine engine element is a combustor wall formed of one of a superalloy, a silicon carbide composite, or a silicon nitride material; and the thermal barrier layer is composed predominately of yttria stabilized zirconia having a thickness in the range of five to one hundred mils.

* * * * *